US007627259B2

(12) United States Patent
Chung et al.

(10) Patent No.: US 7,627,259 B2
(45) Date of Patent: Dec. 1, 2009

(54) FUSER COOLING FAN CONTROL METHOD AND IMAGE FORMING APPARATUS HAVING THE SAME

(75) Inventors: Kyung-Shig Chung, Suwon-si (KR); Min-Goo Choi, Gunpo-si (KR); Sung-Hoon Hong, Suwon-si (KR)

(73) Assignee: Samsung Electronics Co., Ltd, Suwon-Si (KR)

( * ) Notice: Subject to any disclaimer, the term of this patent is extended or adjusted under 35 U.S.C. 154(b) by 437 days.

(21) Appl. No.: 11/402,135

(22) Filed: Apr. 12, 2006

(65) Prior Publication Data

US 2006/0291894 A1 Dec. 28, 2006

(30) Foreign Application Priority Data

Jun. 28, 2005 (KR) ..... 10-2005-0056064

(51) Int. Cl.
*G03G 15/00* (2006.01)

(52) U.S. Cl. ..... 399/44; 399/92; 399/69

(58) Field of Classification Search ..... 399/44, 399/69, 68, 92
See application file for complete search history.

(56) References Cited

FOREIGN PATENT DOCUMENTS

| | | | |
|---|---|---|---|
| JP | 56-099371 | | 8/1981 |
| JP | 08-211763 | | 8/1996 |
| JP | 08262958 | A * | 10/1996 |
| JP | 11143151 | A * | 5/1999 |
| JP | 2001-194980 | | 7/2001 |
| JP | 2004-126125 | | 4/2004 |
| JP | 2004-171013 | | 6/2004 |
| JP | 2005266678 | A * | 9/2005 |
| KR | 2001-104832 | | 11/2001 |

OTHER PUBLICATIONS

Official Translation of JP 2005-266678.*
Official Translation of JP 11-143151.*

* cited by examiner

*Primary Examiner*—David M Gray
*Assistant Examiner*—Laura K Roth
(74) *Attorney, Agent, or Firm*—Roylance, Abrams, Berdo & Goodman, LLP

(57) ABSTRACT

A method and apparatus for fuser cooling fan control is provided. An image forming apparatus so configured comprises a fixing unit, a cooling fan for cooling the fixing unit, a detecting sensor for measuring ambient temperature and humidity of the image forming apparatus, and a controller for recognizing ambient temperature and humidity change from the measurement provided by the detecting sensor. The controller controls operation of the cooling fan according to the temperature and humidity change detected. The controller delays operation of the cooling fan by an amount of time if the ambient temperature and/or humidity is below a reference temperature and humidity level.

13 Claims, 4 Drawing Sheets

FUSER COOLING FAN CONTROL METHOD AND IMAGE FORMING APPARATUS HAVING THE SAME

PRIORITY

This application claims the benefit under 35 U.S.C. § 119 (a) of Korean patent application No. 2005-56064, filed Jun. 28, 2005, in the Korean Intellectual Property Office, the entire content of which is hereby incorporated by reference.

BACKGROUND OF THE INVENTION

1. Field of the Invention

The present invention relates generally to an image forming apparatus. More particularly, the present invention relates to a fuser cooling fan control method for varying the operation timing of the cooling fan for cooling a fusing unit according to the surrounding environment (that is, temperature and/or humidity) and an image forming apparatus having the same.

2. Description of the Related Art

In an electro-photographic image forming apparatus, a color or monochromatic image formed by an image forming unit is transferred onto printing paper by a transfer unit. The image is fixed onto the paper through a fixing unit, and the paper with the image is then discharged. The fixing unit applies high heat and high pressure to the paper where the image is to be transferred. Because of the high heat and pressure, the fixing unit can get overheated. To prevent overheating of the fixing unit, the image forming apparatus employs a fuser cooling fan for cooling the fixing unit.

As shown in a timing chart in FIG. 1, the cooling fan is turned on/off, interlockingly with the on/off state of the image forming apparatus. That is, when the power of the image forming apparatus is turned on, the cooling fan is also turned on and running. On the other hand, when the image forming apparatus is in sleep mode, the cooling fan remains turned off until a printing operation of the apparatus is initiated.

Because the on/off state of the above-described fuser cooling fan in the image forming apparatus is controlled by the power on/off mode of an image forming apparatus, irrespective of the surrounding environment (that is, temperature and/or humidity), an image fixing defect may be caused.

For example, when the ambient temperature and/or humidity of the image forming apparatus is at or lower than room temperature (10-32° C.) and normal humidity (30-80%), printing using paper and developer occurs at a relatively low temperature because the cooling fan runs from the initial phase of the printing process. Thus, the printing paper is not sufficiently heated, and an image fixing defect occurs.

SUMMARY OF THE INVENTION

Accordingly, it is an object of exemplary embodiments of the present invention to provide a fuser cooling fan control method for preventing an image fixing defect by varying the timing of the fuser cooling fan according to the surrounding environment (that is, temperature and/or humidity), and an image forming apparatus having the same.

To achieve the above objects and exemplary advantages, a method and apparatus are provided where a fuser cooling fan is used in an image forming apparatus and, among other things, the ambient temperature and humidity change around the image forming apparatus is sensed, and operation timing of the cooling fan is varied depending on changes in temperature and humidity.

In an exemplary embodiment of the present invention, if the temperature and/or humidity is below a reference temperature and/or humidity, the operation timing of the cooling fan is delayed by an amount of time.

In an exemplary embodiment, the reference temperature can be 32° C. and the reference humidity can be 80%.

In an exemplary embodiment of the present invention, if the ambient temperature is between 10 and 32° C., the cooling fan operates after 1-2 sheets of paper are printed. If the ambient temperature falls below 10° C., the cooling fan operates after 3-5 sheets of paper are printed. Moreover, if the ambient temperature is at or above 32° C., the cooling fan operates immediately without delay.

Furthermore, in an exemplary embodiment of the present invention, if the ambient temperature is between 10 and 32° C. and the humidity is between 30 and 80%, the cooling fan operates after 1-2 sheets of paper are printed, and if the ambient temperature falls below 10° C. and the humidity falls below 30%, the cooling fan operates after 3-5 sheets of paper are printed. And if the ambient temperature is at or above 32° C. and the humidity is at or above 80%, the cooling fan operates immediately without delay.

Another aspect of an exemplary embodiment of the present invention provides a control method for a fuser cooling fan used in an image forming apparatus. The method comprises measuring an ambient temperature of a place where the image forming apparatus is installed, and if the ambient temperature is at or below a reference temperature, delaying an operation timing of the cooling fan by an amount of time.

Still another aspect of an exemplary embodiment of the present invention provides an image forming apparatus comprising a fixing unit, a cooling fan for cooling the fixing unit, a detecting sensor for measuring an ambient temperature and/or humidity of the image forming apparatus, and a controller for recognizing an ambient temperature and/or humidity change from the measurement provided by the detecting sensor, and controlling an operation timing of the cooling fan according to the temperature and/or humidity change.

In an exemplary embodiment of the present invention, if the ambient temperature and/or humidity falls below a reference temperature and/or humidity, the controller delays the operation timing of the cooling fan by an amount of time. In an exemplary embodiment, the reference temperature can be 32° C. and the reference humidity can be 80%.

In an exemplary embodiment, if the ambient temperature is between 10 and 32° C., the controller delays the operation timing of the cooling fan until 1-2 sheets of paper are printed. If the ambient temperature falls below 10° C., the controller delays the operation timing of the cooling fan until 3-5 sheets of paper are printed. And if the ambient temperature is at or above 32° C., the controller operates the cooling fan immediately without delay.

BRIEF DESCRIPTION OF THE DRAWINGS

The above aspects and exemplary features of the present invention will be more apparent by describing certain exemplary embodiments of the present invention with reference to the accompanying drawings, in which.

Throughout the drawings, like reference numbers should be understood to refer to like elements, features, and structures.

DETAILED DESCRIPTION OF EXEMPLARY EMBODIMENTS

The matters exemplified in this description are provided to assist in a comprehensive understanding of various exemplary embodiments of the present invention disclosed with reference to the accompanying figures. Accordingly, those of ordinary skill in the art will recognize that various changes and modifications of the exemplary embodiments described herein can be made without departing from the scope and spirit of the claimed invention. Descriptions of well-known functions and constructions are omitted for clarity and conciseness.

Figure 1:
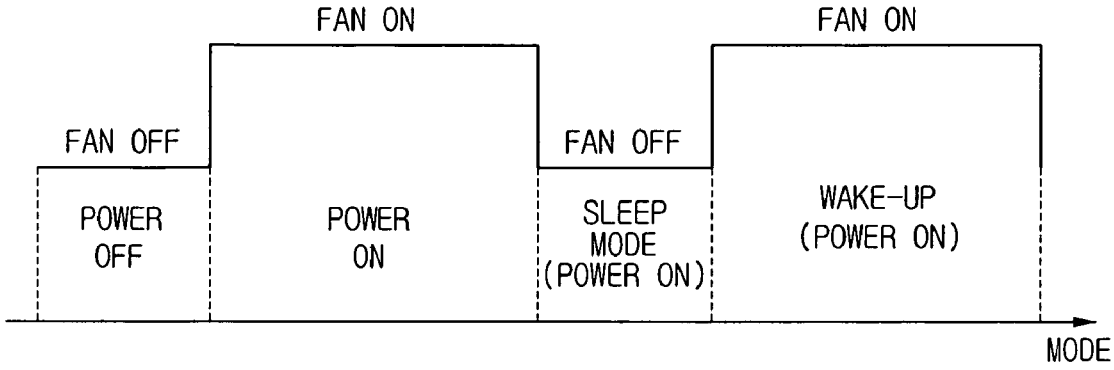
FIG. 1 (PRIOR ART)
FIG. 1 is a timing chart for explaining a control method for a fuser cooling fan used in a traditional image forming apparatus.
Figure 2:
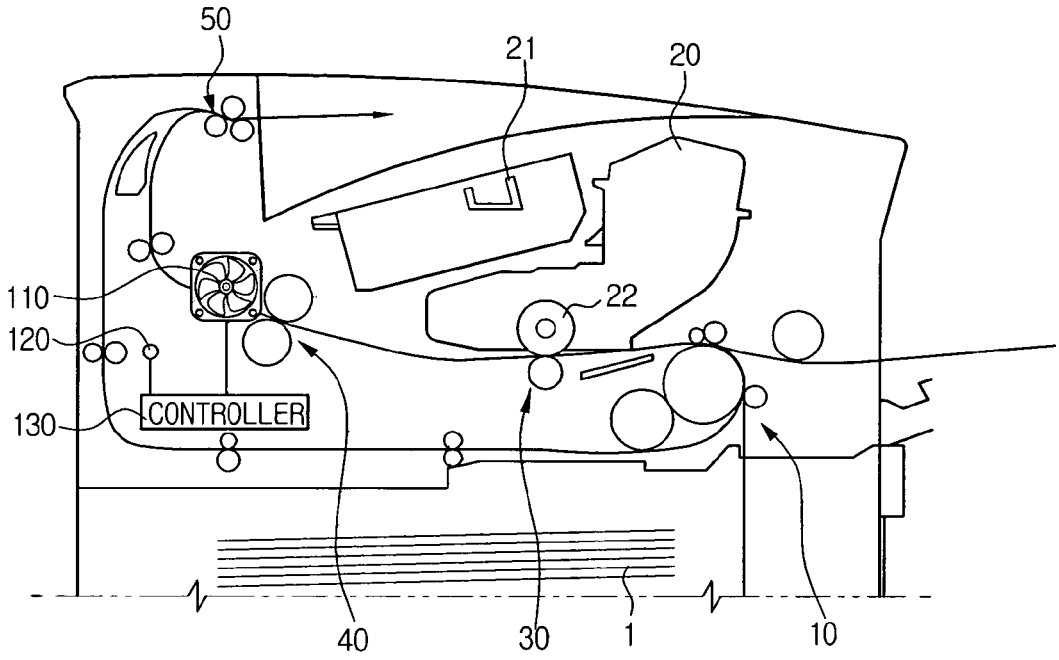
FIG. 2 is a schematic view of an image forming apparatus to which a fuser cooling fan control method of an exemplary embodiment of the present invention is applied.

FIG. 2 is a schematic view of an image forming apparatus according to an exemplary embodiment of the present invention.

As shown in FIG. 2, an image forming apparatus according to an exemplary embodiment of the present invention comprises a paper feed unit 10, an image forming unit 20, a transfer unit 30, a fixing unit 40, a delivery unit 50, a cooling fan 110, a detecting sensor 120, and a controller 130 for controlling the cooling fan 110 according to a measurement of the detecting sensor 120.

The paper feed unit 10 picks up a sheet of paper loaded in paper cassette 1, and feeds the paper to the transfer unit 30. The image forming unit 20 develops an electrostatic latent image 22 by attaching a developer to a photosensitive medium 22 on which the electrostatic latent image 22 is formed by a light (that is, a laser beam) emitted from laser scanning unit 21. The transfer unit 30 imparts a visible image formed on the photosensitive medium 22 electrostatically to a print paper. The fixing unit 40 applies high temperature/high pressure to the print image to fix it onto the surface of the print paper. The delivery unit 50 discharges the paper bearing the print image to the outside of the apparatus.

The cooling fan 110 serves to prevent overheating of the fixing unit 40. The cooling fan 110 can be either a blow-in type (which pulls in outside air into the image forming apparatus) or a blow-out type (which blows air inside of the image forming apparatus to the outside).

The detecting sensor 120 senses the ambient temperature and humidity around the image forming apparatus, and outputs the measurement to the controller 130.

When the image forming apparatus is warmed up and the fixing unit 40 starts running, the controller 130 controls operation timing of the cooling fan 110 according to the information obtained on the ambient temperature and humidity of the image forming apparatus provided from the detecting sensor 120.

According to an exemplary embodiment of the present invention, the operation timing of the cooling fan 110 is delayed if the ambient temperature and humidity around the image forming apparatus are lower than the reference temperature and humidity. In exemplary embodiments, the reference temperature (or baseline temperature) can be 32° C., and the reference humidity (or baseline humidity) can be 80%.

Figure 3:
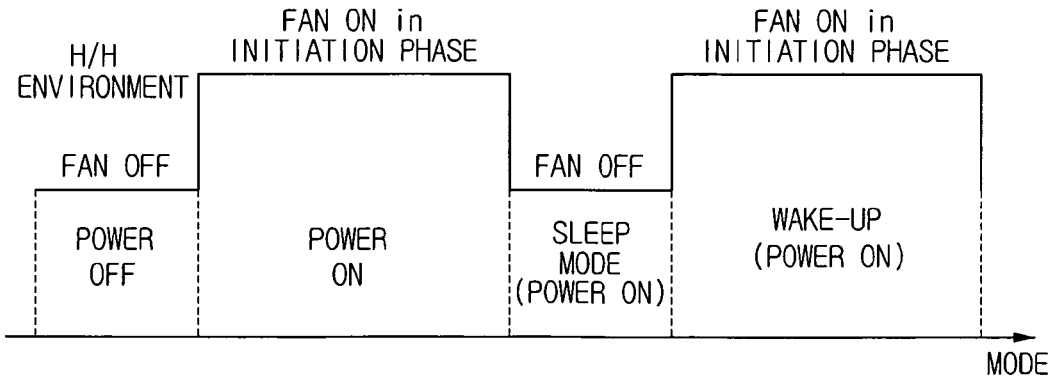
FIGS. 3 to 5 are timing charts showing the cooling fan on/off timings in a fuser cooling fan control method according to an exemplary embodiment of the present invention.

As depicted in the timing chart of FIG. 3, when the surrounding environment of the image forming apparatus sensed by the detecting sensor 120 is high temperature (above 32° C.) and high humidity (above 80%) (H/H environment), the controller 130 turns on the cooling fan 110 without delay provided that the image forming apparatus is turned on or changed to wake-up mode from sleep mode.

Figure 4:
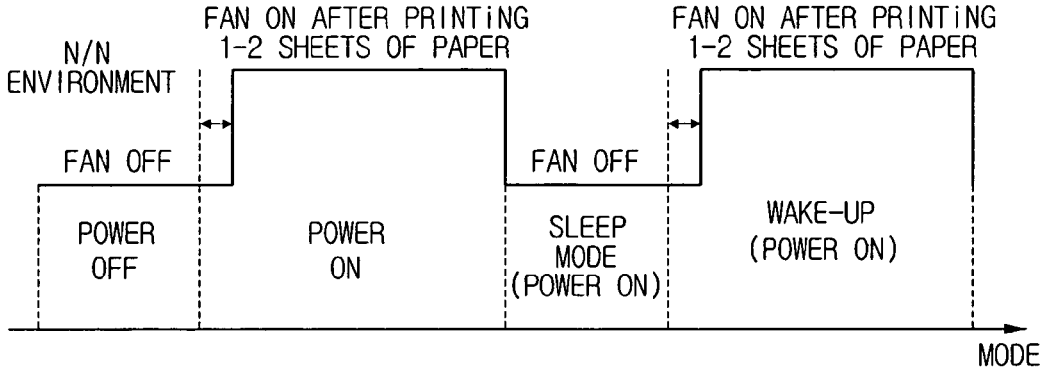

On the other hand, as depicted in the timing chart of FIG. 4, when the surrounding environment of the image forming apparatus sensed by the detecting sensor 120 is at room or normal temperature (10-32° C.) and normal humidity (30-80%) (that is, N/N environment), the controller 130 delays operation of the cooling fan 110 until 1-2 sheets of paper are printed. Since the temperature of the developer or the print paper is close to room temperature, very little heat from the fixing unit 40 is transferred to the paper. In the initial stage of the printing process, however, part of the heat from the fixing unit 40 may be absorbed by the print page(s), so the fixing temperature is lowered. Thus, the operation of the cooling fan 110 should be delayed to prevent the fixing unit 40 from being cooled off at a lower temperature than the temperature required for fixing an image.

Figure 5:
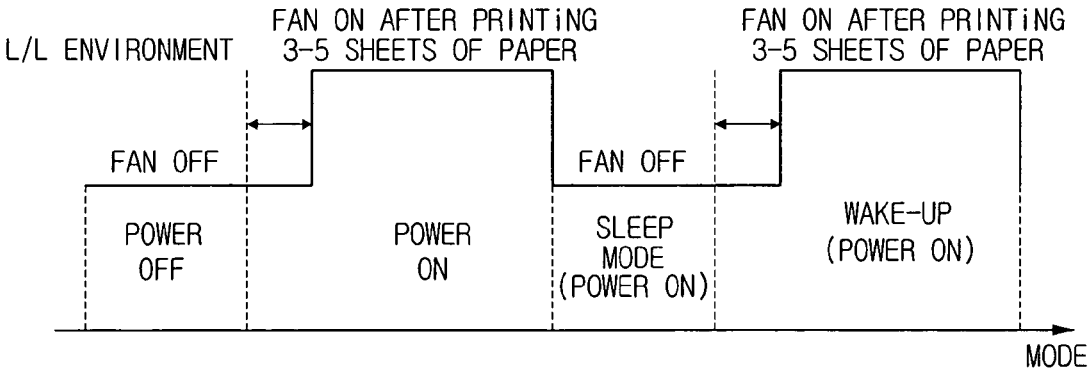

As depicted in the timing chart of FIG. 5, when the surrounding environment of the image forming apparatus sensed by the detecting sensor 120 is at low temperature (below 32° C.) and low humidity (above 80%) (that is, an L/L environment), the controller 130 delays operation of the cooling fan 110 until at least 3 sheets of paper, and in some exemplary embodiments 5 sheets of paper, are printed. This environment corresponds to a case where the image forming apparatus is placed in a very cold environment (for example, below 0° C.) or in an environment having a temperature that is lower than room temperature. In such an environment, the developer inside the developing unit 10, and the print papers are initially at a low-temperature and the print papers entering the fixing unit 40 may absorb excessive heat from the fixing unit 40. Therefore, in order to compensate such heat loss, the operation of the cooling fan 110 is delayed until about 3-5 sheets of papers pass through the fixing unit 40.

Sometimes, the controller 130 controls the cooling fan 110 based on the ambient temperature of the image forming apparatus. That is, if the ambient temperature measured by the detecting sensor 120 is at or above a reference temperature, for example, 32° C., the controller 130 recognizes the environment as a high temperature environment. The controller 130 then immediately operates the cooling fan 110 without delay. Similarly, if the ambient temperature measurement indicates room temperature between, for example, 10 and 32° C., the controller 130 delays operation of the cooling fan 110 until 1-2 sheets of paper are printed. If the ambient temperature measurement is low, for example, below 10° C., the controller 130 delays operation of the cooling fan 110 until 3-5 sheets of paper are printed.

Figure 6:
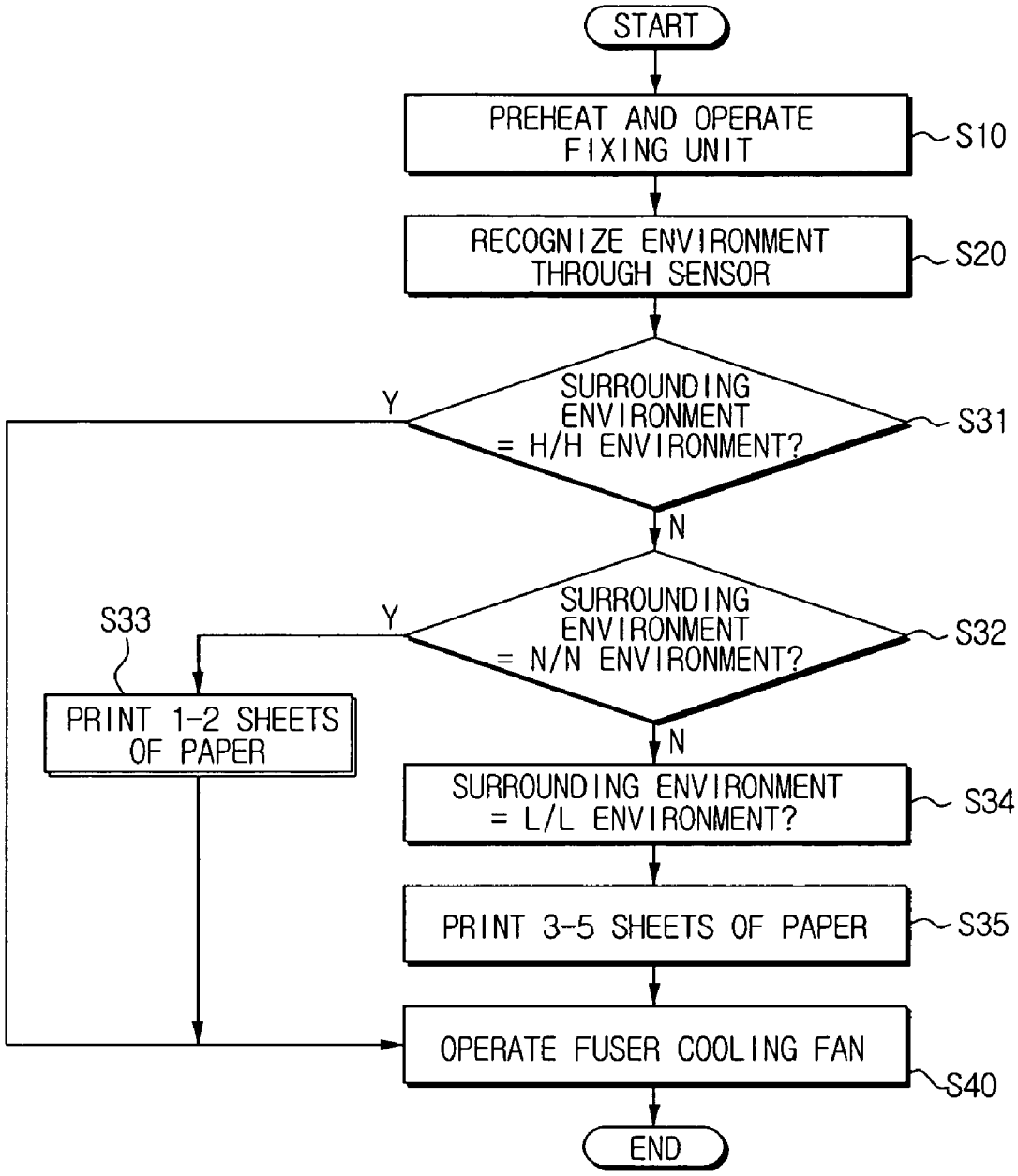
FIG. 6 is a flow chart for explaining a fuser cooling fan control method of an image forming apparatus according to an exemplary embodiment of the present invention.

The following now explains a fuser cooling fan control method of an exemplary embodiment of the present invention, with reference to the flow chart in FIG. 6.

When the image forming apparatus is initiated, the fixing unit 40 goes through preheat/heating phases and applies high temperature/high pressure to a sheet of paper which also went through a predetermined printing procedure, and fixes a print image thereon, step S10.

At this time the detecting sensor 120 senses the ambient temperature or humidity of a place where the image forming apparatus is installed, and outputs the information to the controller 130, step S20.

Then the controller 130 controls operation of the cooling fan 110 according to the ambient temperature and humidity information provided by the detecting sensor 120. For example, when the ambient temperature of the image forming apparatus is above 32° C. and the humidity is above 80% (that is, an H/H environment), step S31, the cooling fan 110 starts running concurrently with the fixing unit 40, step S40. On the other hand, when the ambient temperature of the image forming apparatus corresponds to a temperature between 10 and 32° C., that is, room temperature, and the humidity corresponds to normal humidity between 30 and 80% (that is, an N/N environment), step S32, the cooling fan 110 does not start until the fixing unit 40 fixes 1-2 sheets of paper, step S33. Moreover, when the ambient temperature of the image forming apparatus is below 10° C. and the humidity is below 30% (that is, an L/L environment), step S34, the cooling fan 110 does not start (step S40) until the fixing unit 40 fixes 3-5 sheets of paper and the papers are printed, step S35.

When the image forming apparatus is in an N/N environment or an L/L environment, part of the heat from the fixing unit 40 is absorbed by the print papers and developer that have been kept at a relatively low temperature. Thus, the fixing unit 40 may not maintain the required temperature for fixing. If the cooling fan 110 runs regardless of the current status of the fixing unit 40, the fixing unit 40 cannot maintain a sufficient fixing temperature, resulting in an image fixing defect.

According to exemplary embodiments of the present invention, however, operation of the cooling fan is varied, depending on the ambient temperature and humidity where the image forming apparatus is installed. Therefore, it becomes possible to prevent the image fixing defect caused by overcooling of the fixing unit during the initiation phase of printing.

While the present invention has been particularly shown and described with reference to certain exemplary embodiments thereof, it will be understood by those of ordinary skill in the art that various changes in form and detail may be made therein without departing from the spirit and scope of the present invention as defined by the appended claims and equivalents thereof.

What is claimed is:

1. A method for controlling a fuser cooling fan, the method comprising:

sensing at least one of an ambient temperature and ambient humidity around an image forming apparatus;

determining at least one of a temperature range and a humidity range;

detecting a number of sheets printed by the image forming apparatus;

comparing the sensed at least one of ambient temperature and ambient humidity to the at least one of a temperature range and a humidity range; and varying operation of the cooling fan based on the comparison and the number of sheets printed to cool a fixing unit of the image forming apparatus, wherein, if the at least one of temperature and humidity is below a reference temperature comprising 32° C. and a reference humidity comprising 80%, respectively, the operation of the cooling fan is delayed, and wherein, if the ambient temperature is between 10° C. and 32° C., the cooling fan operates after 1-2 sheets of paper are printed, and if the ambient temperature is below 10° C., the cooling fan operates after 3-5 sheets of paper are printed.

2. The method according to claim 1, wherein, if the ambient temperature is at or above 32° C., the cooling fan operates without the delay.

3. The method according to claim 1, wherein, if the humidity is between 30 and 80%, the cooling fan operates after 1-2 sheets of paper are printed, and if the humidity is below 30%, the cooling fan operates after 3-5 sheets of paper are printed.

4. The method according to claim 1, wherein, if the humidity is at or above 80%, the cooling fan operates without the delay.

5. A method for controlling a fuser cooling fan, the method comprising:

measuring an ambient temperature in a location comprising an image forming apparatus;

detecting a number of sheets printed by the image forming apparatus; and if the ambient temperature is at or below a reference temperature comprising 32° C., delaying operation of the cooling fan until the number of sheets printed exceeds a predetermined number of printed sheets for cooling a fixing unit of the image forming apparatus, wherein the reference temperature; if the ambient temperature is between 10° C. and 32° C., the cooling fan operates after 1-2 sheets of paper are printed; and if the ambient temperature is below 10° C., the cooling fan operates after 3-5 sheets of paper are printed.

6. The method according to claim 5, wherein if the ambient temperature is at or above 32° C., the cooling fan operates without the delay.

7. An image forming apparatus, comprising:

a fixing unit;

a cooling fan for cooling the fixing unit;

a sensor for measuring ambient temperature and humidity; and a controller for determining a number of sheets printed by the image forming apparatus and for controlling operation of the cooling fan based on at least one of the temperature and humidity sensed by the sensor and the number of sheets printed by the image forming apparatus, wherein, if the at least one of the ambient temperature and ambient humidity is below a reference temperature comprising 32° C. and a reference humidity comprising 80%, respectively the controller delays the operation of the cooling fan, and wherein, if the ambient temperature is between 10° C. and 32° C., the controller delays the operation of the cooling fan until 1-2 sheets of paper are printed, and if the ambient temperature is below 10° C., the controller delays the timing of the cooling fan until 3-5 sheets of paper are printed.

8. The apparatus according to claim 7, wherein, if the ambient temperature is at or above 32° C., the controller operates the cooling fan without the delay.

9. The apparatus according to claim 7, wherein, if at least one of the ambient temperature is between 10° C. and 32° C. and the humidity is between 30% and 80%, the controller delays the operation of the cooling fan until 1-2 sheets of paper are printed; and if at least one of the ambient temperature is below 10° C. and the humidity is below 30%, the controller delays the operation of the cooling fan until 3-5 sheets of paper are printed.

10. The apparatus according to claim 9, wherein, if at least one of the ambient temperature is at or above 32° C. and the humidity is at or above 80%, the controller operates the cooling fan without the delay.

11. A method for controlling a fuser cooling fan of a printer, the method comprising:

sensing at least one of an ambient temperature and humidity around an image forming apparatus;

determining at least a normal temperature/normal humidity mode and a low temperature/low humidity mode and a high temperature/high humidity mode for operating the cooling fan based on the sensed at least one of temperature and humidity;

operating the cooling fan according to the normal temperature/normal humidity mode and a low temperature/low humidity mode and a high temperature/high humidity mode to cool a fixing unit of the image forming apparatus;

delaying operation of the cooling fan until one of one and two sheets of paper are printed from the printer in response to operating in the normal temperature/normal humidity mode;

delaying operation of the cooling fan until one of three and five sheets of paper are printed from the printer in response to operating in the low temperature/low humidity mode; and operating the cooling fan immediately in response to operating in the high temperature/high humidity mode.

12. The method of claim 11, further comprising:

determining a low threshold temperature and low threshold humidity;

determining a high threshold temperature and high threshold humidity;

operating the cooling fan in the normal temperature/normal humidity mode when the sensed temperature ranges from the low threshold temperature to the high threshold temperature and the sensed humidity ranges from the low threshold humidity to the high threshold humidity;

operating the cooling fan in the low temperature/low humidity mode when the sensed temperature is below the low threshold temperature and the sensed humidity is below the low threshold humidity; and operating the cooling fan in the high temperature/high humidity mode when the sensed temperature exceeds the high threshold temperature and the sensed humidity exceeds the high threshold humidity.

13. The method of claim 12 wherein the low threshold temperature is 10° C. and the low humidity threshold is 30% and the high threshold temperature is 32° C. and the high threshold humidity is 80%.

* * * * *

UNITED STATES PATENT AND TRADEMARK OFFICE

CERTIFICATE OF CORRECTION

PATENT NO. : 7,627,259 B2
APPLICATION NO. : 11/402135
DATED : December 1, 2009
INVENTOR(S) : Chung et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 670 days.

Signed and Sealed this

Second Day of November, 2010

David J. Kappos

David J. Kappos
*Director of the United States Patent and Trademark Office*